US011329390B2

(12) United States Patent
Göttl

(10) Patent No.: US 11,329,390 B2
(45) Date of Patent: May 10, 2022

(54) MULTIBAND ANTENNA ARRAY FOR MOBILE RADIO APPLICATIONS

(71) Applicant: Telefonaktiebolaget LM Ericsson (publ), Stockholm (SE)

(72) Inventor: Maximilian Göttl, Frasdorf (DE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 13 days.

(21) Appl. No.: 16/971,838

(22) PCT Filed: Feb. 20, 2019

(86) PCT No.: PCT/EP2019/054245
§ 371 (c)(1),
(2) Date: Aug. 21, 2020

(87) PCT Pub. No.: WO2019/162345
PCT Pub. Date: Aug. 29, 2019

(65) Prior Publication Data

US 2021/0083397 A1 Mar. 18, 2021

(30) Foreign Application Priority Data

Feb. 23, 2018 (DE) ..... 10 2018 104 210.8
Aug. 23, 2018 (DE) ..... 10 2018 120 612.7

(51) Int. Cl.
*H01Q 19/10* (2006.01)
*H01Q 21/20* (2006.01)
(Continued)

(52) U.S. Cl.
CPC ..... *H01Q 19/108* (2013.01); *H01Q 1/241* (2013.01); *H01Q 3/36* (2013.01); *H01Q 5/20* (2015.01);
(Continued)

(58) Field of Classification Search
CPC combination set(s) only.
See application file for complete search history.

(56) References Cited

U.S. PATENT DOCUMENTS 6,930,650 B2 8/2005 Göttl
2004/0051677 A1 3/2004 Göttl
(Continued)

FOREIGN PATENT DOCUMENTS

DE 10150150 A1 5/2003
DE 102007060083 A1 6/2009
(Continued)

OTHER PUBLICATIONS

International Search Report and Written Opinion of the International Searching Authority, PCT/EP2019/054245, dated May 20, 2019, 19 pages (including English translation).

*Primary Examiner* — Vibol Tan
(74) *Attorney, Agent, or Firm* — Sage Patent Group

(57) ABSTRACT

A multiband antenna array includes a radiating element array having first and second rows of MIMO radiating elements. The two rows of MIMO radiating elements include a plurality of dual-polarised radiating elements. The radiating element array includes a dual-polarised low-band radiating element. A reflector array is provided, from which a) the dual-polarised radiating elements of the first and second rows of MIMO radiating elements and b) the dual-polarised low-band radiating element are spaced. The dual-polarised low-band radiating element includes at least four directive radiating element devices, which are each offset relative to one another by at least approximately 90° and delimit an accommodation space. In the accommodation space there are at least one or at least two dual-polarised radiating elements from the first row of MIMO radiating elements and at least one or at least two dual-polarised
(Continued)

Figure 1B:
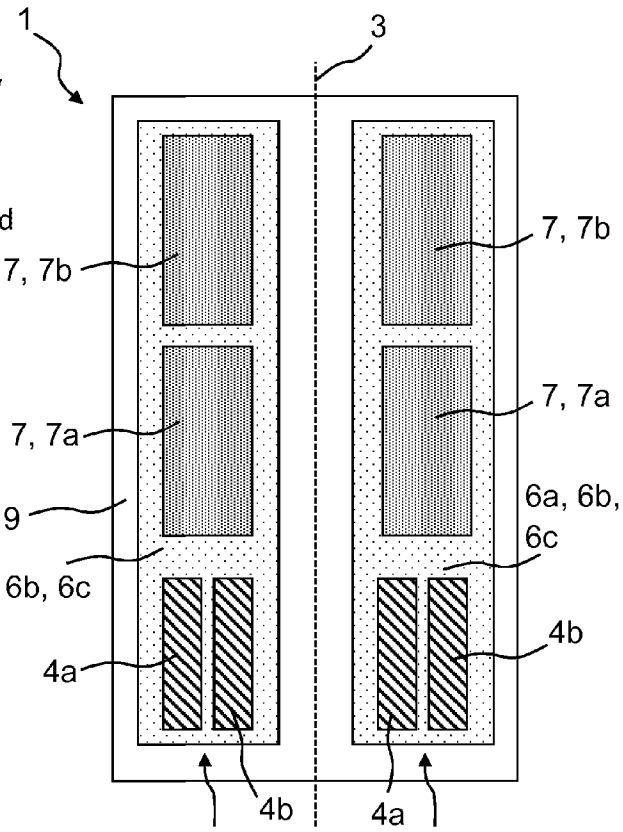

radiating elements from the second row of MIMO radiating elements.

20 Claims, 9 Drawing Sheets

(51) Int. Cl.

| | |
|---|---|
| ***H01Q 21/30*** | (2006.01) |
| ***H01Q 5/35*** | (2015.01) |
| ***H01Q 1/24*** | (2006.01) |
| ***H01Q 3/36*** | (2006.01) |
| ***H01Q 21/24*** | (2006.01) |
| ***H01Q 5/20*** | (2015.01) |

(52) U.S. Cl.
CPC ..... *H01Q 5/35* (2015.01); *H01Q 19/10* (2013.01); *H01Q 21/24* (2013.01); *H01Q 21/30* (2013.01)

(56) References Cited

U.S. PATENT DOCUMENTS

| | | | | |
|---|---|---|---|---|
| 2013/0271336 | A1 | 10/2013 | Piet et al. | |
| 2016/0365647 | A1 | 12/2016 | Du et al. | |
| 2017/0062940 | A1* | 3/2017 | Cao | H01Q 21/24 |
| 2017/0062952 | A1* | 3/2017 | Sundararajan | H01Q 1/523 |
| 2020/0106195 | A1 | 4/2020 | Fleancu et al. | |

FOREIGN PATENT DOCUMENTS

| | | | | |
|---|---|---|---|---|
| DE | 102014014434 | A1 | 3/2016 | |
| DE | 102017116920 | A1 | 12/2018 | |
| EP | 1470615 | B1 | 7/2005 | |
| EP | 3067987 | A1 | 9/2016 | |
| KR | 20140109986 | A * | 9/2014 | H01Q 21/26 |
| WO | 2006058658 | A1 | 6/2006 | |
| WO | WO-2015035400 | A2 * | 3/2015 | H01Q 1/246 |
| WO | WO-2015068981 | A * | 5/2015 | H01Q 21/24 |
| WO | 2016050336 | A1 | 4/2016 | |

* cited by examiner

MULTIBAND ANTENNA ARRAY FOR MOBILE RADIO APPLICATIONS

CROSS REFERENCE TO RELATED APPLICATIONS

This application is a 35 U.S.C. § 371 national stage application of PCT International Application No. PCT/EP2019/054245 filed on Feb. 20, 2019, which in turns claims foreign priority to German Patent Application No. DE 10 2018 120 612.7, filed on Aug. 23, 2018, and German Patent Application No. DE 10 2018 104 210.8 filed on Feb. 23, 2018, the disclosures and content of which are incorporated by reference herein in their entirety.

The invention relates to a multiband antenna array for mobile radio applications. Such multiband antenna arrays comprise different radiating elements to support different mobile radio standards and/or frequency bands.

A multi-column multiband antenna array is known from DE 10 2007 060 083 A1. It comprises different radiating elements that can be operated in different frequency ranges. For example, there are radiating elements that can be operated in a low frequency range and radiating elements that can be operated in a high frequency range. Radiating elements that operate in low frequency ranges necessarily have larger dimensions than radiating elements that operate in high frequency ranges. In the embodiment disclosed there, a radiating element operated in a high frequency range is integrated into a radiating element operated in a low frequency range. The radiating element that is operated in a high frequency range protrudes markedly beyond the radiating element that is operated in a low frequency range. The antenna array disclosed there can be used in different mobile radio systems.

Disadvantages of the multi-column multiband antenna array from DE 10 2007 060 083 A1 are that the structure is still large and also the fact that massive MIMO operation (multiple input, multiple output) is not possible.

It is therefore the object of the present invention to provide a multiband antenna array for mobile radio applications which supports a large number of mobile radio standards or mobile radio frequencies and which is still of a very compact design and can be expanded very easily.

The object is achieved by the multiband antenna array according to the invention as per claim 1. The dependent claims describe further developments according to the invention of the multiband antenna array.

The multiband antenna array according to the invention is suitable for the known mobile radio standards (PCS, PCN, GSM900, GSM1800, UMTS, WIMAX, LTE, AMPS). In particular, massive MIMO (also known as "MaMIMO") is supported in addition to MIMO. For this purpose, the multiband antenna array comprises at least one first radiating element array comprising at least one first and one second row of (Ma)MIMO radiating elements. These rows of (Ma)MIMO radiating elements are arranged adjacently to each other and extend in the longitudinal direction of the multiband antenna array. The first row of MIMO radiating elements comprises a large number of dual-polarised radiating elements. The same applies also to the second row of MIMO radiating elements. Each of the dual-polarised radiating elements is designed to transmit and/or receive in two perpendicular polarisation planes in an upper frequency range. In particular, the polarisation planes are oriented at an angle of ±45° above the horizontal and vertical. Furthermore, the at least one first radiating element array comprises at least one dual-polarised low-band radiating element which is designed to transmit and/or receive in two perpendicular polarisation planes in a lower frequency range. In addition, a reflector array is also provided, which consists of or comprises a common (for example one-piece) reflector or a plurality of individual reflectors. The dual-polarised radiating elements of the first and second rows of MIMO radiating elements are spaced from this reflector array. The same also applies to the at least one dual-polarised low-band radiating element. The at least one dual-polarised low-band radiating element comprises at least four directive radiating element devices, which are each offset relative to one another by at least approximately (less than 5°, 4° 3°, 2°, 1°, 0.5°, 0.2°) 90° and delimit an accommodation space. In this accommodation space of the at least one dual-polarised low-band radiating element there are:

a) at least one dual-polarised radiating element from the first row of MIMO radiating elements and at least one dual-polarised radiating element from the second row of MIMO radiating elements; or b) at least two dual-polarised radiating elements from the first row of MIMO radiating elements and at least two dual-polarised radiating elements from the second row of MIMO radiating elements.

It is particularly advantageous that the multiband antenna array according to the invention comprises a number of rows of MIMO radiating elements (i.e. radiating elements transmitting and/or receiving in an upper frequency range) and that, at the same time, a low-band radiating element is present which can be used for transmitting and receiving in a lower frequency range. In order to achieve the most compact design possible, at least one, preferably at least two, dual-polarised radiating elements from different rows of MIMO radiating elements are arranged in the accommodation space of this dual-polarised low-band radiating element. This allows a large number of dual-polarised radiating elements to be used, without greatly increasing the length of the multiband antenna array, thus enabling massive MIMO operation.

The upper frequency range, i.e. that of the dual-polarised radiating elements of the first and second rows of MIMO radiating elements, is in particular higher than 3.3 GHz, 3.4 GHz, 3.5 GHz, 4 GHz, 4.5 GHz, 5 GHz, or 5.5 GHz, but preferably lower than 6.5 GHz, 6 GHz, 5.5 GHz, 5 GHz, 4.5 GHz, 4 GHz or 3.5 GHz.

In an advantageous development, preferably a number of phase shifters are provided, in order to supply the radiating elements of the corresponding rows of MIMO radiating elements with a corresponding mobile radio signal in the correct phase position. In principle, it would be possible here that, for each radiating element of the first and second rows of MIMO radiating elements, a connection point to a phase shifter is provided for each polarisation level. In this case, a first radiating element of the first or second row of MIMO radiating elements would have a feed point for the first polarisation and a feed point for the second polarisation. The feed point for the first polarisation would be electrically connected to a connection point of a first phase shifter and the feed point for the second polarisation would be electrically connected to a connection point of a second phase shifter. In this case, the feed points of the radiating elements of a row of MIMO radiating elements for the first polarisation would be connected to different connection points of the same phase shifter. The feed points for the other polarisation would likewise be electrically connected to different connection points of a second phase shifter. In principle, however, it would also be possible to electrically connect feed points of at least two adjacent dual-polarised radiating elements of a row of MIMO radiating elements to each other and then to a common connection point of the corresponding phase shifter. The cable length from the connection point of the corresponding phase shifter to the relevant feed point of the corresponding radiating element can be selected individually.

In a preferred embodiment, a partition wall or a partition wall arrangement is formed between the dual-polarised radiating elements of the first and second rows of MIMO radiating elements. Further preferably, the individual dual-polarised radiating elements of the first row of MIMO radiating elements extend equally far away from the reflector array. The same can also apply to the second row of MIMO radiating elements or to the dual-polarised radiating elements of all rows of MIMO radiating elements.

Particularly preferably, the at least one first radiating element array comprises at least one row of wideband radiating elements, which is arranged at the end of the first and second rows of MIMO radiating elements and extends the multiband antenna array in the longitudinal direction. The at least one row of wideband radiating elements comprises a large number of dual-polarised wideband radiating elements, wherein each dual-polarised wideband radiating element is designed to transmit and/or receive in two perpendicular polarisation planes in a medium frequency range. Thus, the multiband antenna array can support additional mobile radio standards or frequency bands.

In a preferred embodiment, the multiband antenna array also comprises a second radiating element array. This is constructed in particular in exactly the same way as the first radiating element array described above. The first and the second radiating element array run parallel to each other and therefore extend in the longitudinal direction of the multiband antenna array. In principle, the first and the second radiating element array can be arranged adjacently to each other. However, it would also be possible for a third and/or fourth radiating element array to be provided between the first and second radiating element array. The third and the fourth radiating element array likewise comprise at least one first and one second row of MIMO radiating elements, which are arranged adjacently to each other and again extend in the longitudinal direction of the multiband antenna array. However, the third and the fourth radiating element array preferably do not comprise a dual-polarised low-band radiating element. A partition wall arrangement is preferably provided between the adjacent radiating element arrays in order to achieve decoupling and also a certain directivity.

Figure 1A:
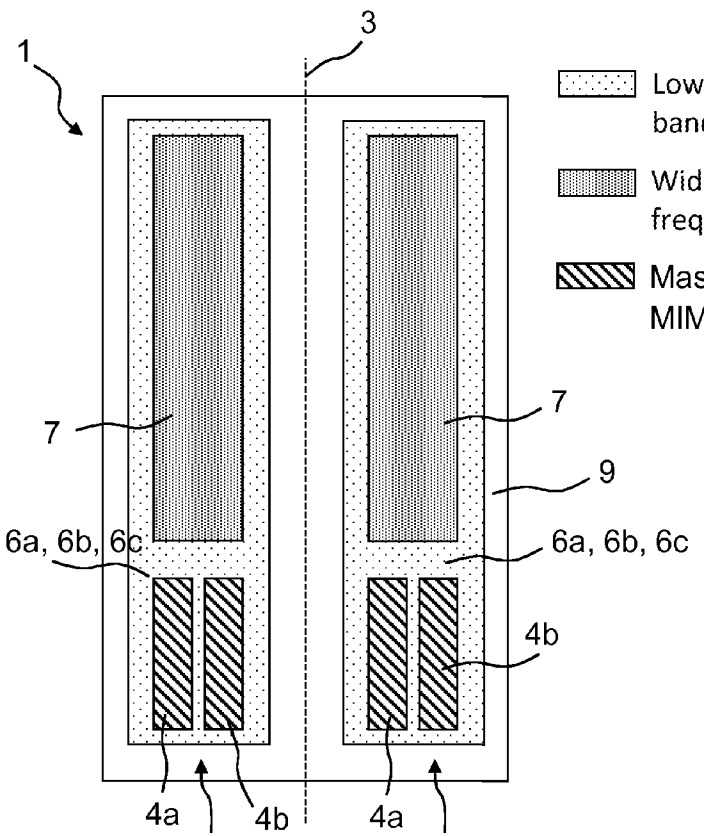
Figure 1D:
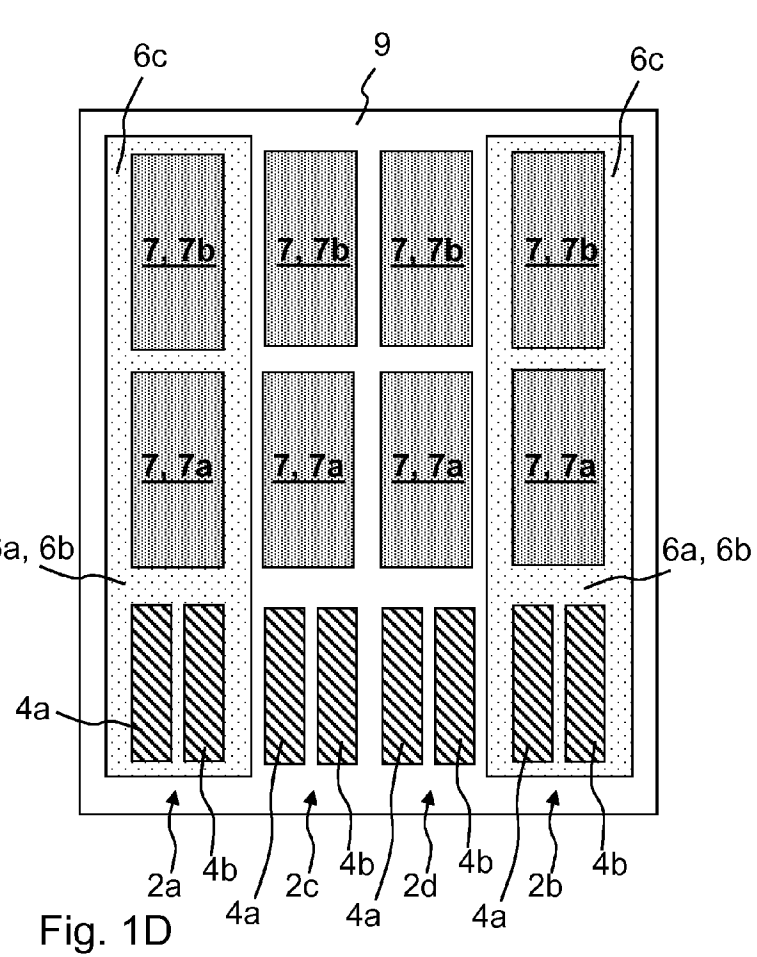
Figure 1C:
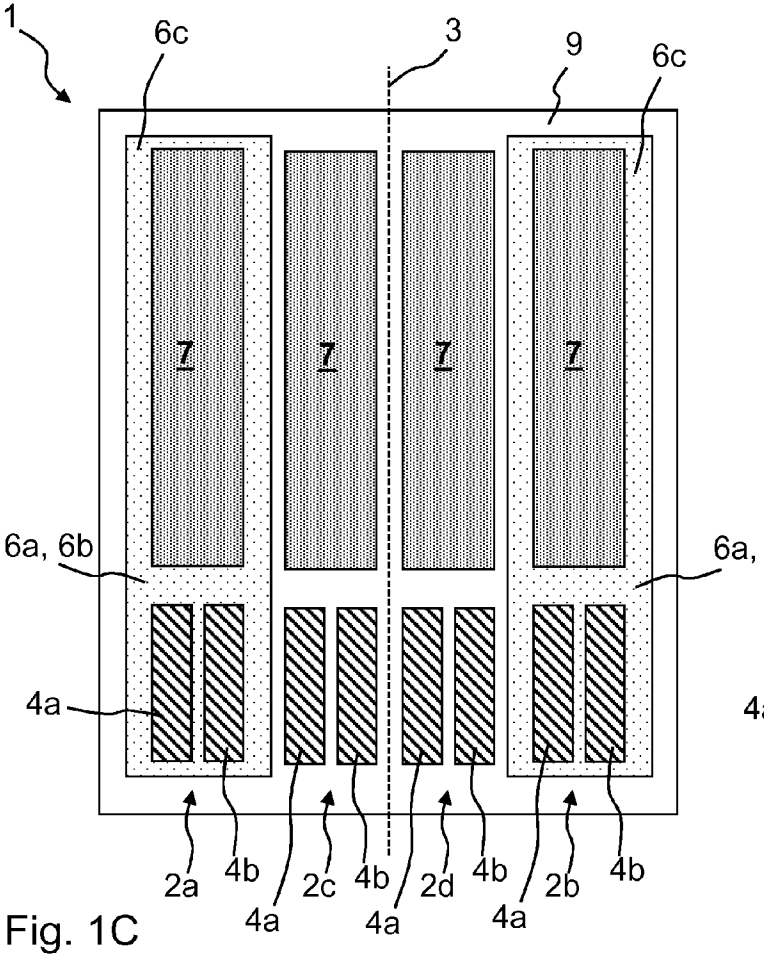
Figure 2:
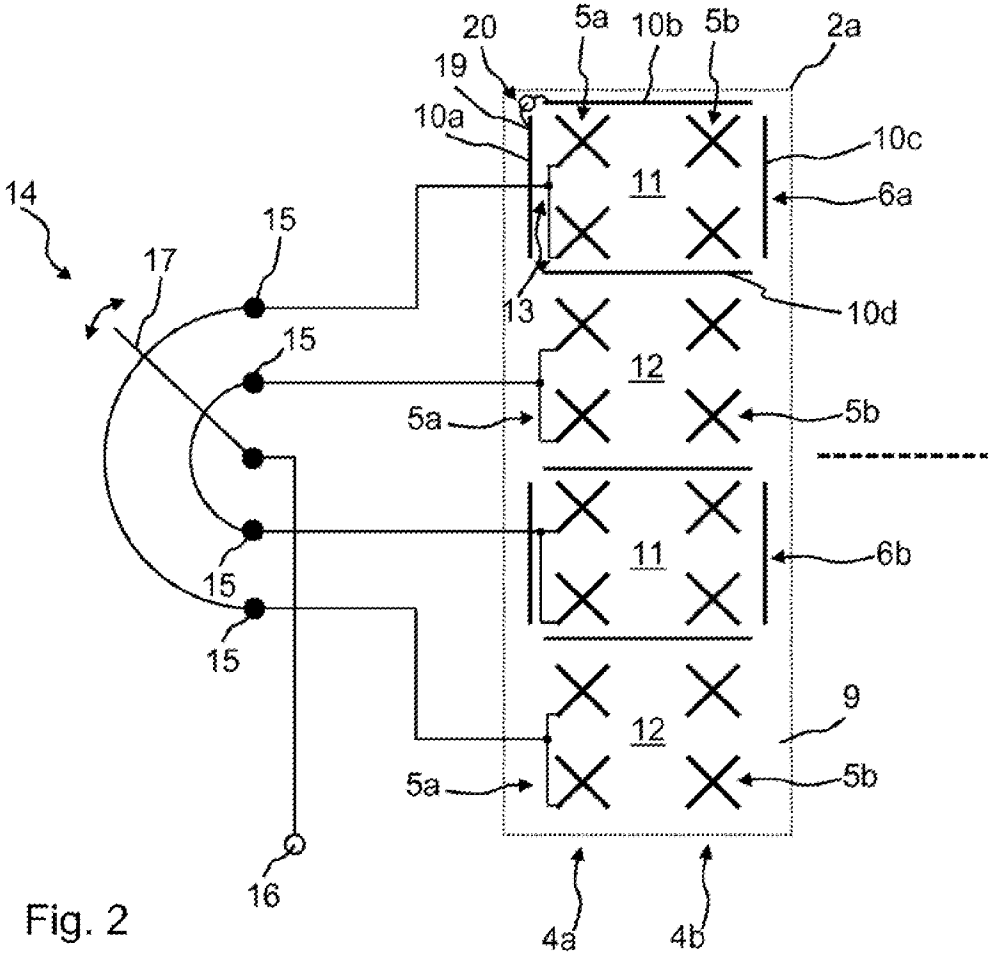
Figure 3:
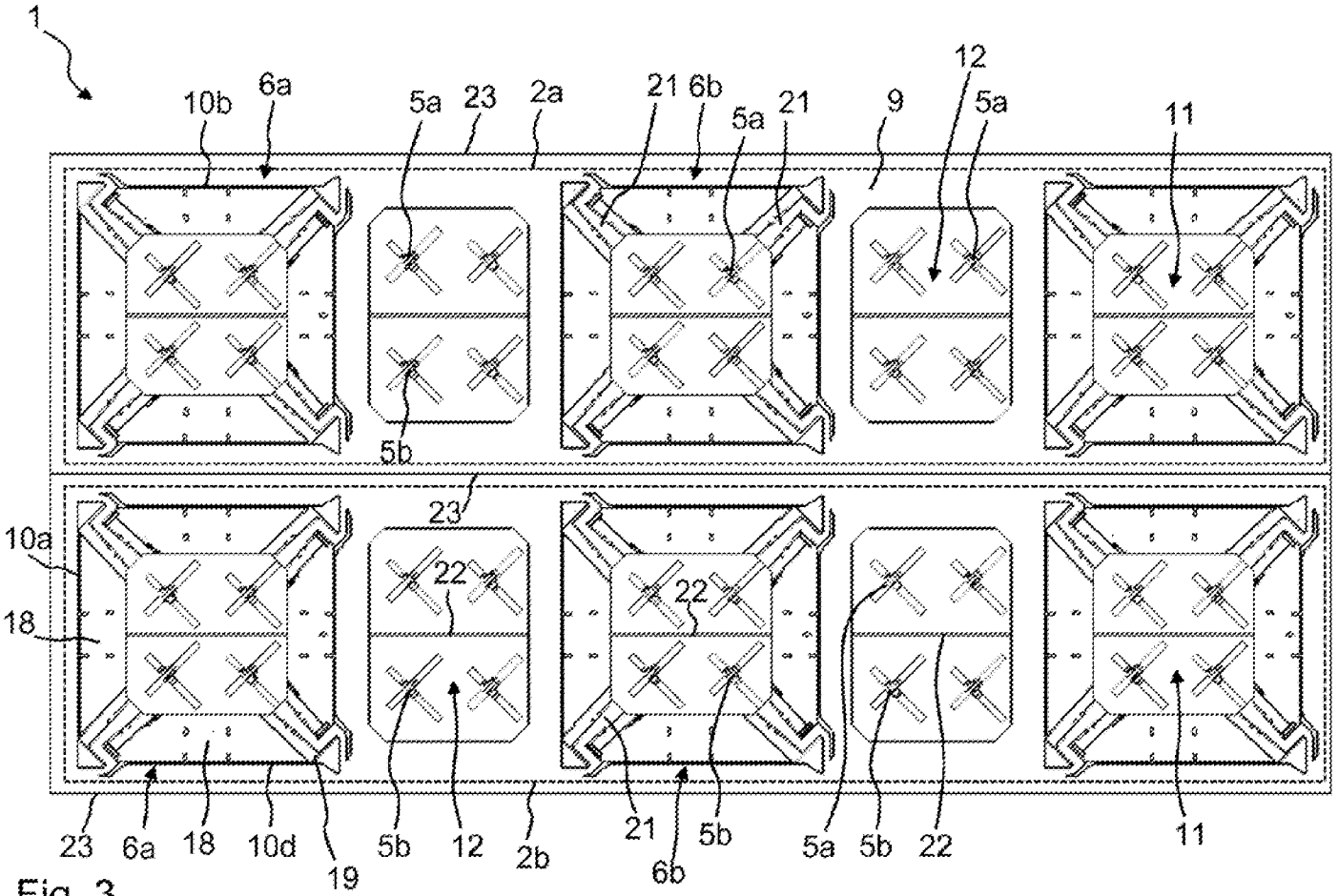
Figure 4:
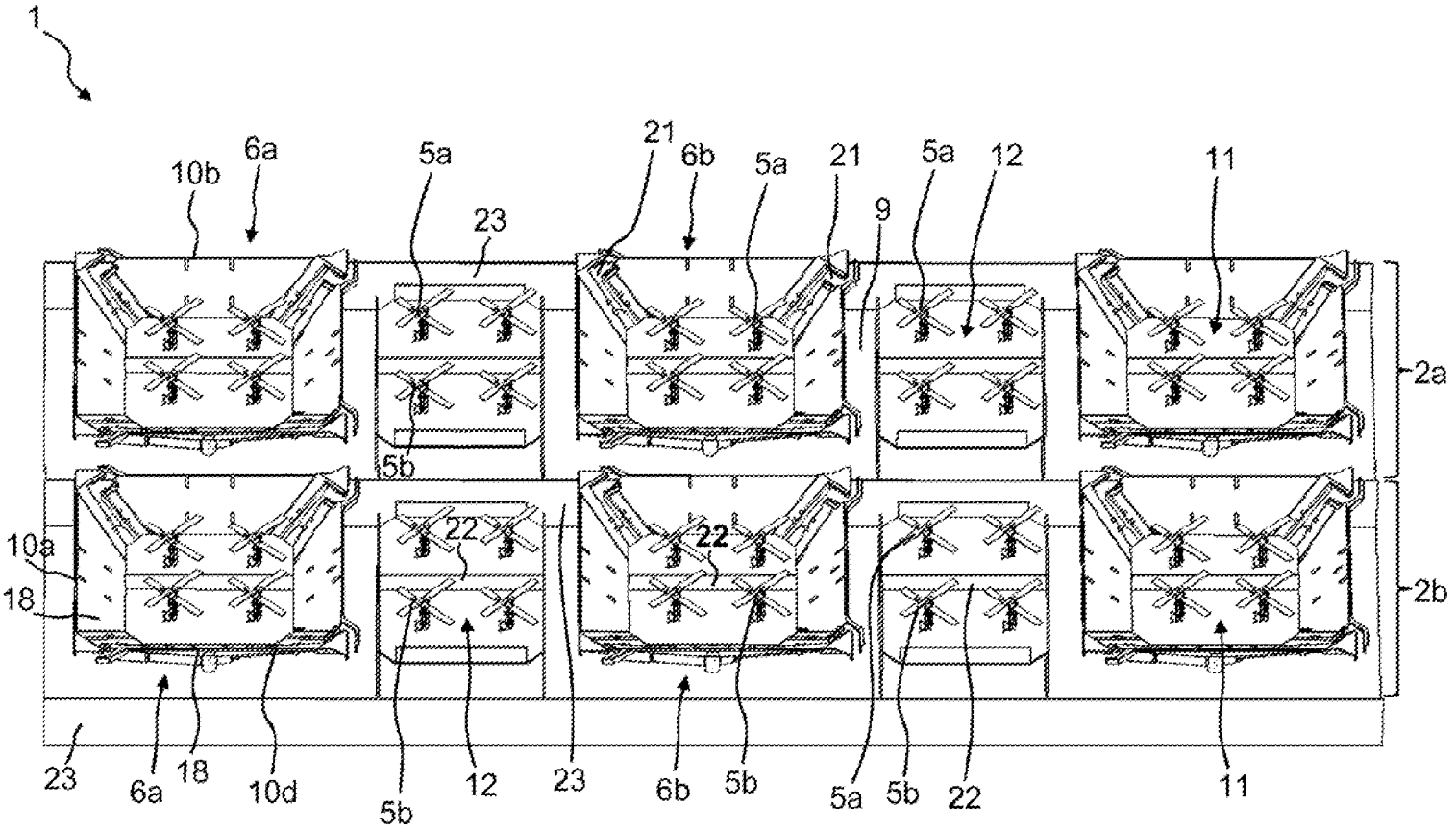
Figure 5:
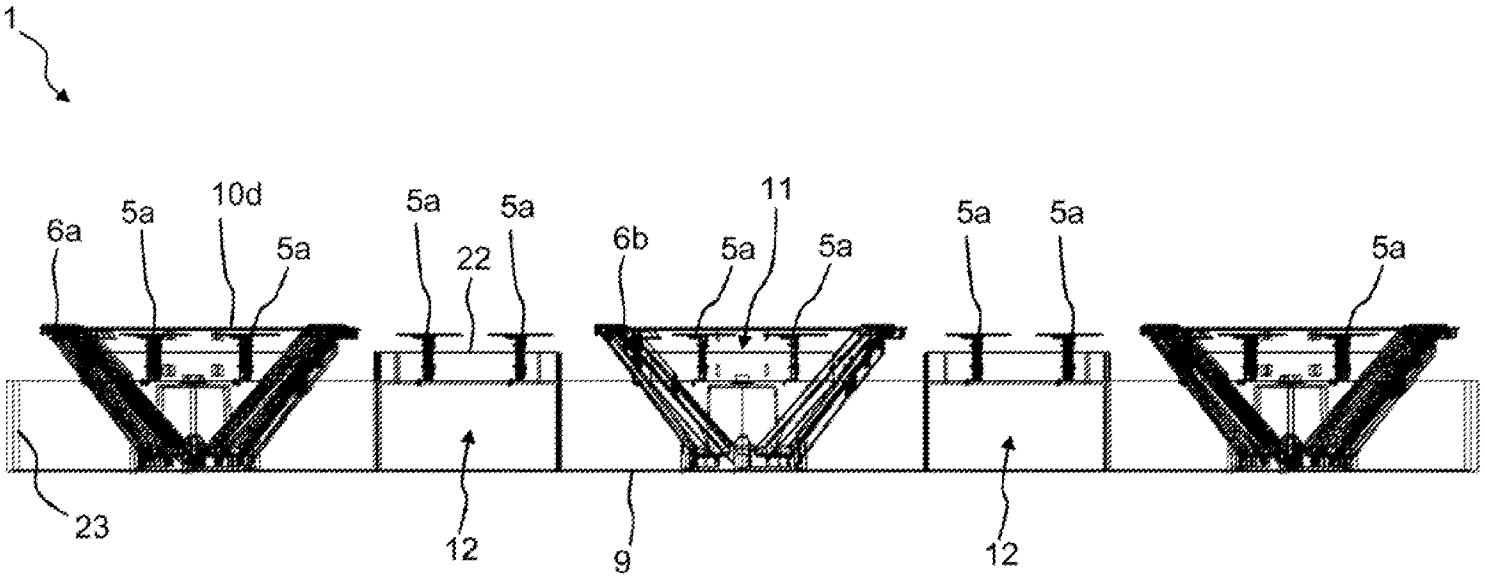

Various embodiments of the invention will be described below by way of example, with reference to the drawings. Like objects have like reference signs. The corresponding figures of the drawings show, specifically:

FIGS. 1A and 1B:

schematic representations of the multiband antenna array according to the invention with a first and a second radiating element array;

FIGS. 1C and 1D:

schematic representations of the multiband antenna array according to the invention with a first, a second, a third and a fourth radiating element array;

FIG. 2: an exemplary connection point of a first polarisation of a row of MIMO radiating elements of a radiating element array to a phase shifter;

FIG. 3: a plan view of part of an exemplary design of the first and second radiating element array;

FIG. 4: a three-dimensional depiction of the view in FIG. 3;

FIG. 5: a side view of the example in FIG. 3;

FIGS. 6A, 6B:

plan views of an embodiment of the multiband antenna array according to the invention with four radiating element arrays; and

FIGS. 7A, 7B, 7C:

different embodiments of a holding device of a radiating element device.

FIG. 1A to 1D show a schematic representation of various embodiments of the multiband antenna array 1 according to the invention. FIGS. 1A and 1B show that the multiband antenna array 1 comprises a first radiating element array 2*a* and a second radiating element array 2*b*. FIGS. 1C and 1D show that the multiband antenna array 1 comprises a first radiating element array 2*a*, a second radiating element array 2*b*, a third radiating element array 2*c* and a fourth radiating element array 2*d*. The structure for the first radiating element array 2*a* will be described further below. The second radiating element array 2*b* has an identical structure. For the third and fourth radiating element array 2*c* and 2*d* there are slight differences, which will be explained in more detail at the relevant points in relation to FIGS. 1C and 1D.

The at least one first radiating element array 2*a* extends in the longitudinal direction 3 of the multiband antenna array 1. In the installed state of the multiband antenna array 1 (in particular on an antenna mast), reference may also be made to a vertical direction instead of to the longitudinal direction 3.

The at least one first radiating element array 2*a* comprises at least one first and one second row 4*a*, 4*b* of MIMO radiating elements (see also FIG. 2). These are arranged adjacently to one another and extend likewise in the longitudinal direction 3. The first row 4*a* of MIMO radiating elements comprises a large number of dual-polarised radiating elements 5*a* (preferably more than 2, 3, 4, 5, 6, 7, 8, 9, 10, 11, 12, 13, 14, 15, 16, 17, 18, 19 or more than 20), wherein each of the dual-polarised radiating elements 5*a* is designed to transmit and/or receive in two perpendicular polarisation planes. The same also applies to the second row 4*b* of MIMO radiating elements. This also comprises a large number of dual-polarised radiating elements 5*b*.

The first and the second row 4*a*, 4*b* of MIMO radiating elements are shown in FIGS. 1A to 1D with a hatched structure.

The first and the second row 4*a*, 4*b* of MIMO radiating elements are designed in particular to transmit and/or receive in an upper frequency range. The first and the second row 4*a*, 4*b* of MIMO radiating elements are particularly suitable for use in massive MIMO.

The multiband antenna array 1 also comprises a reflector array 9, on which the first row 4*a* of MIMO radiating elements and the second row 4*b* of MIMO radiating elements are arranged. The reflector array 9 can consist of a continuous reflector or of a number of individual reflectors. These are electrically conductive.

The at least one first radiating element array 4*a* comprises at least one dual-polarised low-band radiating element 6*a*, which is designed to transmit and/or receive in two perpendicular polarisation planes. This dual-polarised low-band radiating element 6*a* is shown in FIGS. 1A to 1D with coarse dots and is shown in more detail in the subsequent figures. The second radiating element array 2*b* also comprises at least one such dual-polarised low-band radiating element 6*a*.

This dual-polarised low-band radiating element 6*a* is designed to transmit and/or receive in a lower frequency range. The lower frequency range of the at least one dual-polarised low-band radiating element 6*a* is below the upper frequency range of the dual-polarised radiating elements 5*a*, 5*b* of the first and the second row 4*a*, 4*b* of MIMO radiating elements. In particular, the lower frequency range is 698 MHz to 960 MHz (+/S %).

The at least one dual-polarised low-band radiating element 6*a* of the first and the second radiating element array 2*a*, 2*b* is also arranged on the reflector array 9 or spaced from the reflector array 9.

The at least one dual-polarised low-band radiating element 6*a* comprises at least four directive radiating element devices 10*a*, 10*b*, 10*b* and 10*d*, as shown in FIG. 2. These are offset relative to one another by at least approximately 90° and delimit an accommodation space 11. The exact construction of the dual-polarised low-band radiating elements 6*a* will be described again in more detail with reference to the later figures. With regard to FIG. 2, it is also shown that a directive radiating element device 10*a* is connected at a first end 19 to the inner conductor of a feeding coaxial cable, whereas the second radiating element device 10*b*, adjacent to the first end 19 of the first directive radiating element device 10*a*, is connected at its first end to the outer conductor of this coaxial cable. Such a feed is preferably carried out at all ends of the directive radiating devices 10*a* to 10*d*.

The accommodation space 11, which is delimited by the radiating element devices 10*a* to 10*d*, serves to accommodate at least one dual-polarised radiating element 5*a* from the first row 4*a* of MIMO radiating elements and at least one dual-polarised radiating element 5*b* from the at least one second row 4*b* of MIMO radiating elements. Preferably, however, at least two dual-polarised radiating elements 5*a* from the first row 4*a* of MIMO radiating elements and at least two dual-polarised radiating elements 5*b* from the second row 4*b* of MIMO radiating elements are arranged in the accommodation space 11. The at least one first radiating element array 2*a* could also include further rows of MIMO radiating elements. Some of their dual-polarised radiating elements would then also be arranged in the accommodation space 11.

FIG. 2 also shows that the at least one first radiating element array 2*a* also comprises at least one further dual-polarised low-band radiating element 6*b*. The at least one further dual-polarised low-band radiating element 6*b* is arranged in the longitudinal direction 3 of the multiband antenna array 1, spaced from the at least one dual-polarised low-band radiating element 6*a*. In an accommodation space 11 of the at least one further dual-polarised low-band radiating element 6*b*, there is in turn at least one, preferably two (as shown in FIG. 2) dual-polarised radiating elements 5*a* of the first row 4*a* of MIMO radiating elements. The same applies to the second row 4*b* of MIMO radiating elements.

A gap 12 is formed between the at least one dual-polarised low-band radiating element 6*a* and the at least one further dual-polarised low-band radiating element 6*b*. In this gap 12, there are also at least one dual-polarised radiating element 5*a* of the first row 4*a* of MIMO radiating elements and at least one dual-polarised radiating element 5*b* of the second row 4*b* of MIMO radiating elements. In the embodiment shown in FIG. 2, there are two dual-polarised radiating elements 5*a*, 5*b* in each case. However, there could also be more. Preferably, in no case are two dual-polarised low-band radiating elements 6*a*, 6*b* arranged directly adjacently to each other without a gap in between.

The low-band radiating elements 6*a*, 6*b* and the dual-polarised radiating elements 5*a*, 5*b* are preferably separate structures and are not constructed in one piece. This means that they can be installed one after the other on the reflector array 9.

With regard to FIG. 2, it can also be seen that the dual-polarised radiating elements 5*a* of the first row 4*a* of MIMO radiating elements are arranged approximately along a straight line.

The distances between the individual dual-polarised radiating elements 5*a* are approximately equal in this case (+/−5%). The same applies to the dual-polarised radiating elements 5*b* in the second row 4*b* of MIMO radiating elements. These are also arranged along a straight line, wherein, here too, the distances between the individual dual-polarised radiating elements 5*b* are approximately the same. These two straight lines run parallel to each other in the embodiment from FIG. 2. Furthermore, the number of dual-polarised radiating elements 5*a* of the first row 4*a* of MIMO radiating elements corresponds to the number of dual-polarised radiating elements 5B of the second row 4*b* of MIMO radiating elements. In principle, the number could also differ.

The at least one dual-polarised low-band radiating element 6*a* and the at least one further dual-polarised low-band radiating element 6*b* are also arranged along a straight line. This runs parallel to the straight lines of the dual-polarised radiating elements 5*a* and 5*b* of the first and the second row 4*a*, 4*b* of MIMO radiating elements. In principle, there can also be more dual-polarised low-band radiating elements. The distance between two dual-polarised low-band radiating elements 6*a*, 6*b* in the longitudinal direction 3 is preferably greater than 0.5λ, 0.6λ, 0.7λ, 0.8λ, 0.9λ, 1λ, 1.1λ, 1.2λ 1.3λ, 1.4λ, 1.5λ and is preferably smaller than 2λ, 1.7λ, 1.4λ, 1.2λ, 1λ, 0.8λ or 0.6λ, where λ is the wavelength of the middle frequency with respect to the frequency range in which the at least one dual-polarised low-band radiating element 6*a* and the at least one further dual-polarised low-band radiating element 6*b* are operated.

The dual-polarised radiating elements 5*a* of the first row 4*a* of MIMO radiating elements and the dual-polarised radiating elements 5*b* of the second row 4*b* of MIMO radiating elements comprise a feed point 13 for the first polarisation and a feed point for the second polarisation. FIG. 2 shows only the feed point 13 for the first polarisation. The multiband antenna array 1 also comprises a first phase shifter 14. The feed points 13 for the first polarisation of at least two (directly) adjacent dual-polarised radiating elements 5*a* of the first row 4*a* of MIMO radiating elements are connected to one another. They are furthermore connected to a common connection point 15 of the first phase shifter 14. The cable length from this common connection point 15 of the first phase shifter 14 to the corresponding feed points 13 of the dual-polarised radiating elements 5*a* can be of equal or different length. In principle, it would also be possible for the feed points 13 for the first polarisation of the dual-polarised radiating elements 5*a* of the first row 4*a* of MIMO radiating elements to be electrically connected to different connection points 15 of the phase shifter 14. In this case, the first phase shifter 14 comprises as many connection points 15 as there are dual-polarised radiating elements 5*a* in the first row 4*a* of MIMO radiating elements. The first phase shifter 14 also comprises a common connection point 16, which can be used to receive or transmit data streams. Depending on the position of a tap element 17, the phase shift between a signal at the common connection point 16 and the individual connection points 15 can be changed.

It is not shown that there is also a second phase shifter, which is electrically connected to the feed points for the second polarisation of the dual-polarised radiating elements 5*a* of the first row 4*a* of MIMO radiating elements. The same applies also to the dual-polarised radiating elements 5*b* with respect to the first and second polarisation of the second row 4*b* of MIMO radiating elements. For this purpose there is also a third and a fourth phase shifter. The same applies to the second radiating element array 2*b*, the third radiating element array 2*c* and the fourth radiating element array 2*d*. Corresponding phase shifters are preferably also available for the at least one dual-polarised low-band radiating element 6*a* and the at least one further dual-polarised low-band radiating element 6*b*. The down-tilt angle can be adjusted by changing the phase position. This allows the cell illumination to be changed.

FIG. 2 shows that the feed points 13 of the first or second polarisation of those of the at least two adjacent dual-polarised radiating elements 5*a*, 5*b* of the first or second row 4*a*, 4*b* of MIMO radiating elements that are arranged inside the accommodation space 11 or outside the accommodation space 11, especially in the gap 12, are connected to each other.

The at least one first radiating element array 2*a* comprises at least one row 7 of wideband radiating elements, which is arranged at the end of the first and second row 4*a*, 4*b* of MIMO radiating elements and extends the multiband antenna array 1 in the longitudinal direction 3. It is not shown in FIG. 1 that the at least one row 7 of wideband radiating elements comprises a plurality of dual-polarised wideband radiating elements, wherein each of the dual-polarised wideband radiating elements is designed in particular to transmit and/or receive in two perpendicular polarisation planes in a medium frequency range. This medium frequency range of the dual-polarised wideband radiating elements of the at least one row 7 of wideband radiating elements lies above the lower frequency range of the at least one dual-polarised low-band radiating element 6*a*, 6*b* and below the upper frequency range of the dual-polarised radiating elements 5*a*, 5*b* of the first and the second row 4*a*, 4*b* of MIMO radiating elements. The medium frequency range is in particular higher than 1.3 GHz or 1.4 GHz or 1.427 GHz or 1.5 GHz or 1.6 GHz or 1.695 GHz, but preferably lower than 3 GHz or 2.8 GHz or 2.7 GHz or 2.690 GHz.

Preferably, the at least one first radiating element array comprises additional dual-polarised low-band radiating elements 6*c*. At least one of the dual-polarised wideband radiating elements of the at least one row 7 of wideband radiating elements is then arranged in the accommodation space of said low-band radiating elements. Preferably, all low-band radiating elements 6*a*, 6*b*, 6*c* of the first radiating element array 2*a* are arranged on a straight line.

FIG. 1A also shows that the second radiating element array 2*b* also comprises at least one row 7 of wideband radiating elements. With regard to this row 7 of wideband radiating elements, the same statements apply as those already given for the row 7 of wideband radiating elements of the first radiating element array 2*a*. The at least one second radiating element array 2*b* also comprises additional dual-polarised low-band radiating elements 6*c*.

The dual-polarised wideband radiating elements of the at least one row 7 of wideband radiating elements can be divided into different groups 7*a*, 7*b*. In FIG. 1A there is only one group. This means that the feed points for the first polarisation of all dual-polarised wideband radiating elements of the at least one row 7 of wideband radiating elements are connected at least indirectly (for example via a phase shifter) to the same signal source. The same applies also to the feed points for the second polarisation. Thus, all feed points for the second polarisation of all dual-polarised wideband radiating elements of the at least one row 7 of wideband radiating elements are at least indirectly connected to the same signal source. The signal sources for the first and second polarisation are different.

FIG. 1B, on the other hand, shows a different embodiment. Here, the dual-polarised wideband radiating elements of the at least one row 7 of wideband radiating elements are divided into two groups 7*a*, 7*b*. The dual-polarised wideband radiating elements of the first group 7*a* are connected with their feed points for the first polarisation indirectly (for example via a phase shifter) or directly to a first signal source. By contrast, the dual-polarised wideband radiating elements of the second group 7*b* are connected with their feed points for the first polarisation indirectly (for example via a phase shifter) or directly to a second signal source. Analogously, the dual-polarised wideband radiating elements of the first group 7*a* are connected with their feed points for the second polarisation indirectly (for example via a phase shifter) or directly to a third signal source, whereas the dual-polarised wideband radiating elements of the second group 7*b* are connected with their feed points for the second polarisation indirectly (for example via a phase shifter) or directly to a fourth signal source.

In FIG. 1B this is illustrated by the fact that the row 7 of wideband radiating elements, with regard to the densely dotted area shown, is divided into two sub-areas, i.e. into two groups 7*a* and 7*b*. In principle, the dual-polarised wideband radiating elements of the at least one row 7 of wideband radiating elements could also be divided into more than two groups 7*a*, 7*b*. This would allow different mobile radio standards and/or frequencies to be handled. Thus, site sharing could be operated.

The statements made for FIGS. 1A and 1B with regard to the first radiating element array 2*a* also apply to the second radiating element array 2*b*, and, with respect to FIGS. 1C and 1D, also apply to the third radiating element array 2*c* and the fourth radiating element array 2*d*.

FIGS. 1C and 1D show the third radiating element array 2*c* and the fourth radiating element array 2*d*, which are arranged between the first radiating element array 2*a* and the second radiating element array 2*b* and also run along the longitudinal direction 3. These comprise at least one first and one second row 4*a*, 4*b* of MIMO radiating elements, which are in turn arranged adjacently to one another. A row 7 of wideband radiating elements is also shown in the third and fourth radiating element array 2*c* and 2*d*. By contrast, the third and the fourth radiating element array 2*c*, 2*d* do not have dual-polarised low-band radiating elements 6*a*, 6*b*, 6*c*.

In FIG. 1D, the dual-polarised wideband radiating elements of the first group 7*a* of the first radiating element array 2*a* are operated in a frequency range of from 1427 MHz to 2690 MHz, whereas the wideband radiating elements of the second group 7*b* of the first radiating element array 2*a* are operated in a frequency range of from 1695 MHz to 2690 MHz. By contrast, the wideband radiating elements of both groups 7*a*, 7*b* of the third radiating element array 2*c* are all operated in the frequency range of from 1695 MHz to 2690 MHz. The same also applies to the wideband radiating elements of both groups 7*a*, 7*b* of the fourth radiating element array 2*d*. By contrast, the wideband radiating elements of the first group 7*a* of the second radiating element array 2*b* are operated in the frequency range of from 1427 MHz to 2690 MHz, whereas the wideband radiating elements of the second group 7*b* of the second radiating element array 2*b* are operated in the frequency range of from 1695 MHz to 2690 MHz.

The multiband antenna array 1 according to FIG. 1A has a length of approximately 2 m (±10%) and a width of approximately 37.8 cm (±10%). The multiband antenna array 1 according to FIG. 1B has a length of approximately 2.6 m (±10%) and a width of approximately 37.8 cm (±10%). The multiband antenna array from FIG. 1C has a length of 2 m (±10%) and a width of 48.8 cm (10%). The multiband antenna array 1 from FIG. 1D has a length of 2.6 m (10%) and a width of 48.8 cm (±10%). The housing of the multiband antenna array 1 according to the invention is particularly preferably exactly the same size as the housing already in use, so that older antenna arrays can easily be replaced with the multiband antenna array according to the invention.

FIG. 3 shows a plan view of the first and the second row 4*a*, 4*b* of MIMO radiating elements together with dual-polarised low-band radiating elements 6*a*, 6*b*. The dual-polarised radiating elements 5*a*, 5*b* of the first and the second row 4*a*, 4*b* of MIMO radiating elements are in this case dipolar radiating elements (crossed dipoles). In principle, they could also be vector dipoles or dipole squares. The use of patches would also be possible. The same applies to the wideband radiating elements, which will be discussed later.

The dual-polarised radiating elements 5*a*, 5*b* of the first and the second row 4*a*, 4*b* of MIMO radiating elements are preferably constructed according to DE 10 2017 116 920. The dual-polarised radiating elements 5*a*, 5*b* are characterised in particular by the following features:

- a first dipole radiating element and a second dipole radiating element are provided;
- the first dipole radiating element comprises two dipole halves and the second dipole radiating element comprises two dipole halves;
- the first dipole half of the first dipole radiating element comprises a ground connection point support and a dipole ground wing, wherein a first end of the dipole ground wing is connected to a first end of the ground connection point support, and wherein a second end of the ground connection point support, which is opposite the first end, can be arranged on at least one main body;
- the second dipole half of the first dipole radiating element comprises a signal connection point support having a first end and an opposite, second end and a dipole signal wing, wherein a first end of the dipole signal wing is connected to the first end of the signal connection point support;
- the first dipole half of the second dipole radiating element comprises a ground connection point support and a dipole ground wing, wherein a first end of the dipole ground wing is connected to a first end of the ground connection point support, and wherein a second end of the ground connection point support, which is opposite the first end, can be arranged on the at least one main body;
- the second dipole half of the second dipole radiating element comprises a signal connection point support having a first end and an opposite, second end and a dipole signal wing, wherein a first end of the dipole signal wing is connected to the first end of the signal connection point support;
- the signal connection point support of the first dipole radiating element runs parallel or with one component predominantly parallel to the ground connection point support of the first dipole radiating element, and the signal connection point support of the second dipole radiating element runs parallel or with one component predominantly parallel to the ground connection point support of the second dipole radiating element;
- the dipole signal wing and the dipole ground wing of the first dipole radiating element run in opposite directions;
- the dipole signal wing and the dipole ground wing of the second dipole radiating element run in opposite directions;
- the dipole signal wing of the second dipole radiating element dips under the dipole signal wing of the first dipole radiating element, or the dipole ground wing of the second dipole radiating element dips under the dipole ground wing of the first dipole radiating element, or the dipole ground wing of the first dipole radiating element dips under the dipole signal wing of the second dipole radiating element, or the dipole signal wing of the second dipole radiating element dips under the dipole ground wing of the first dipole radiating element.

The dual-polarised low-band radiating element 6*a*, 6*b*, 6*c* is cup-shaped, goblet-shaped or cognac-glass-shaped and is characterised, for example in accordance with prior publication EP 1470 615 B1, by the following features:

- the dual-polarised low-band radiating element 6*a*, 6*b*, 6*c* has at least four directive radiating element devices 10*a*, 10*b*, 10*c* and 10*d*, which are offset relative to one another by at least approximately 90;
- the four directive radiating element devices 10*a*, 10*b*, 10*c* and 10*d* are each fixed and held by means of a holding device 18 relative to a base or the reflector array 9;
- the radiating element ends 19 of two adjacent radiating element devices 10*a*, 10*b*, 10*c* and 10*d*, which are in each case arranged adjacently to one another in pairs, are in each case isolated from one another at high frequency;
- the radiating element devices 10*a*, 10*b*, 10*c* and 10*d* have feed points 20, so that the radiating element devices 10*a*, 10*b*, 10*c* and 10*d* are fed at least approximately in phase and approximately symmetrically between the opposite feed points 20;
- the four radiating element devices 10*a*, 10*b*, 10*c* and 10*d* each have a directive structure between their opposite radiating element ends 19; and
- the radiating element ends 19 of two adjacent radiating element devices 10*a*, 10*b*, 10*c* and 10*d*, which are in each case arranged adjacently to one another in pairs, form the feed points 20.

Figure 7A:
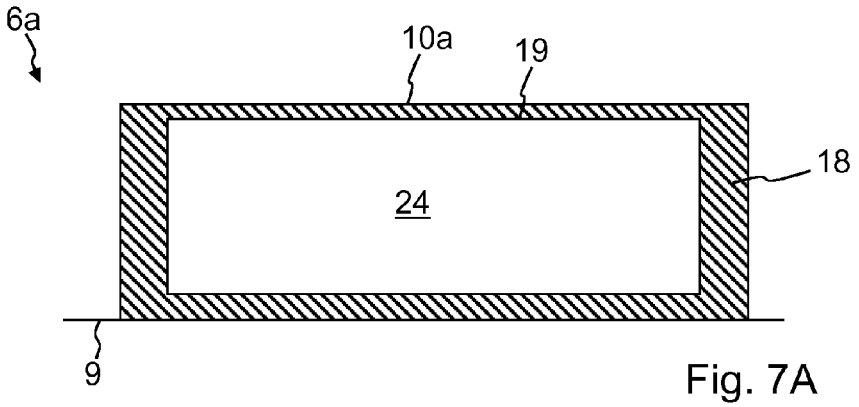
Figure 7B:
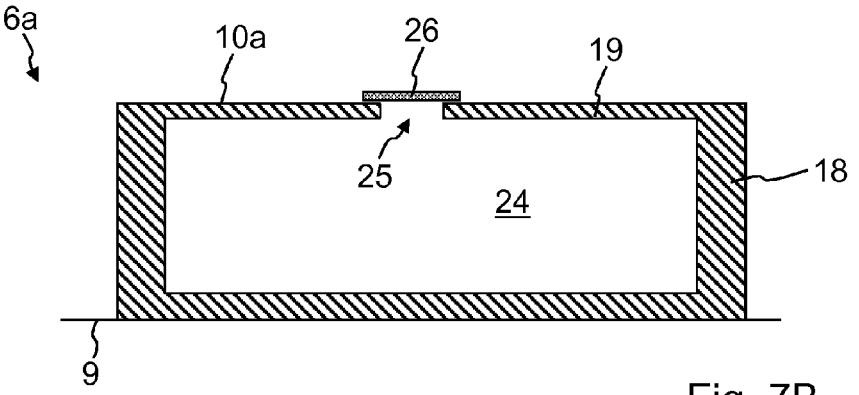
Figure 7C:
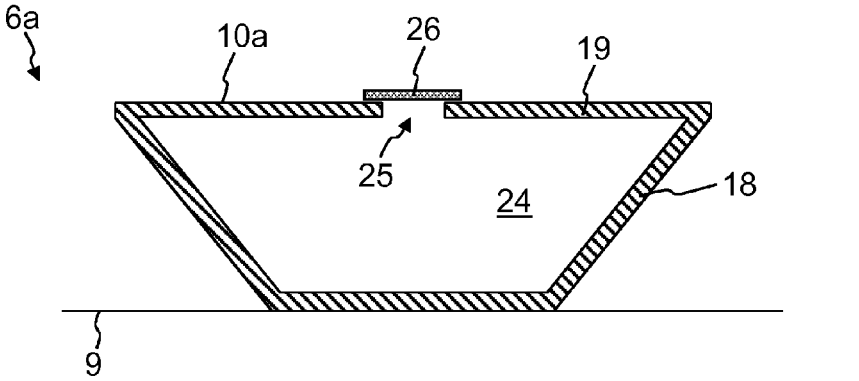

The holding devices 18, via which the four directive radiating element devices 10*a* to 10*d* are held in position and in particular in a common plane (in particular parallel to the reflector array 9), are formed as holding walls in this case. The holding walls preferably extend perpendicularly to the reflector array 9. However, they can also be arranged at an angle to the reflector array 9, wherein the angle is preferably between 45° and 90°. The angle is further preferably greater than 45° or 55°, 65°, 75° or 85° but less than 90° or 80°, 70°, 60° or 50° (the low-band radiating elements 6*a*, 6*b* become wider from the reflector array 9). The holding devices 18 could also be designed as holding frames, wherein a corresponding recess 24 would be provided in the middle. Such a design is shown in FIG. 7A, for example. The recess can save material and thus weight. The radiating element devices 10*a* to 10*d* can comprise both a continuous electrically conductive surface between the radiating element ends 19 as well as interruptions 25, which are bridged by corresponding capacitive couplings for the high-frequency mobile radio signals. The interruptions would therefore not be visible for the high-frequency mobile radio signals. Such an overcoupling could be achieved by additional electrically conductive metal parts 26 (for example metal plates). Such a design is shown in FIG. 7B. The metal parts 26 in this case are not galvanically connected to the radiating element devices 10*a* to 10*d*. With such a construction and the corresponding arrangement of the metal parts 26, the radiating element devices 10*a* to 10*d* can also be tuned subsequently with regard to their operating frequencies. The metal parts 26 can be kept spaced apart, via spacers, and thus galvanically isolated from the radiating element devices 10*a* to 10*d*, or dielectric spacers are arranged between them. A similar design with a, not absolutely necessary, interruption 25 and recess 24 is also shown in FIG. 7C. The holding device 18 is in this case trapezoidal, wherein the side at the radiating element ends 19 is longer than the side at the reflector array 9. Overall, the low-band radiating element 6*a*, 6*b* constructed in this way becomes wider from the reflector array 9.

A (balancing) slot 21 is formed between two holding devices 18 of different radiating element devices 10*a* to 10*d*. This slot extends away from the reflector array 9 in the direction of the radiating element devices 10*a* to 10*d*. The two holding devices 18 between which the slot 21 is formed are partially nested in one another so that the slot 21 has a course that is angled (in particular at 90°) at least once or, as shown, multiple times. The feed point 20 is preferably formed at the end of slot 21 which is preferably furthest away from the reflector array 9.

FIG. 3 also shows that those of the dual-polarised radiating elements 5*a* of the first row 4*a* of MIMO radiating elements that are arranged inside the accommodation spaces 11 are arranged along a first straight line, and those of the dual-polarised radiating elements 5*a* of the first row 4*a* of MIMO radiating elements that are arranged outside the accommodation spaces 11 (for example in the gaps 12) are arranged along a second straight line. In the example from FIG. 3, the first straight line is spaced from the second straight line, but arranged in parallel. This means that there is a slight offset transverse to the longitudinal direction 3 between the dual-polarised radiating elements 4*a* of the first row 5*a* of MIMO radiating elements, depending on whether these are arranged inside or outside the accommodation spaces 11. In principle, it would also be possible for the course of the two straight lines to be identical (i.e. free of an offset). The same applies to the dual-polarised radiating elements 5*b* of the second row 4*b* of MIMO radiating elements and to the further radiating element arrays 2*b*, 2*c* and 2*d*.

Furthermore, it can be seen that a distance between two dual-polarised radiating elements 5*a*, arranged adjacently in the longitudinal direction 3, of the first row 4*a* of MIMO radiating elements is greater if one of these radiating elements 5*a* is arranged inside the accommodation space 11 and the other of these adjacent radiating elements 5*a* is arranged outside the accommodation space 11 than if both of the radiating elements 5*a* arranged adjacently in the longitudinal direction are arranged inside the accommodation space 11 or outside the accommodation space 11. This also applies to two dual-polarised radiating elements 5*b*, arranged adjacently in the longitudinal direction, of the second row 4*b* of MIMO radiating elements.

A partition wall arrangement 22 is arranged between the dual-polarised radiating elements 5*a*, 5*b* of the first and the second row 4*a*, 4*b* of MIMO radiating elements. This partition wall arrangement 22 may consist of a large number of partition walls, of which at least one may also be arranged inside the accommodation space 11. In principle, those of the dual-polarised radiating elements 5*a*, 5*b* of the first and the second row 4*a*, 4*b* of MIMO radiating elements which are arranged in the gap 12 between two dual-polarised low-band radiating elements 6*a*, 6*b*, 6*c* can also be completely enclosed by a partition wall arrangement 22. This could be open at the corner regions. Preferably, there is only no partition wall between the dual-polarised radiating elements 5*a*, 5*b* of the same row 4*a*, 4*b* of MIMO radiating elements.

Between two adjacent radiating element arrays 2*a*, 2*b*, 2*c*, 2*d* there is preferably also a further partition arrangement 23. The partition wall arrangement 22 and the further partition wall arrangement 23 originate at the reflector array 9 and protrude away from it and consist of an electrically conductive material or comprise an electrically conductive material.

The dual-polarised radiating elements 5*a* of the first row 4*a* of MIMO radiating elements are arranged in the longitudinal direction 3 of the multiband antenna array 1 without any offset to the dual-polarised radiating elements 5*b* of the second row 4*b* of MIMO radiating elements.

FIG. 4 shows a three-dimensional depiction of the plan view from FIG. 3. The partition wall arrangements 22, which surround the dual-polarised radiating elements 5*a*, 5*b* of the same row 4*a* or 4*b* of MIMO radiating elements, are at least partially open at their outer corner regions. Preferably, these partition wall arrangements 22 are also lower than the further partition wall arrangement 23, which separates the individual radiating element arrays 2*a*, 2*b*, 2*c*, 2*d* from each other.

FIG. 5 shows a side view of the embodiment from FIG. 3. The holding device 18 of the low-band radiating elements 6*a*, 6*b*, 6*c* is inclined and diverges with increasing distance from the reflector array 9.

In addition, the dual-polarised radiating elements 5*a* in the first row 4*a* of MIMO radiating elements extend equally far away from the reflector array 9. The same applies also to the dual-polarised radiating elements 5*b* in the second row 4*b* of MIMO radiating elements. The dual-polarised radiating elements 5*a*, 5*b* of both rows 4*a*, 4*b* of MIMO radiating elements can also extend equally far away from reflector array 9.

The dual-polarised radiating elements 5*a*, 5*b* of the first and/or second row 4*a*, 4*b* of MIMO radiating elements which are arranged inside the accommodation space 11 of the relevant dual-polarised low-band radiating element 6*a*, 6*b*, 6*c* do not protrude outwards (i.e. further from the reflector array 9) beyond this dual-polarised low-band radiating element 6*a*, 6*b*, 6*c*. Preferably, they end flush with it or are less than 5 cm, 4 cm, 3 cm, 2 cm, or 1 cm lower. The dual-polarised radiating elements 5*a*, 5*b* can also be arranged on a platform. This can consist of a dielectric material, for example.

Figure 6A:
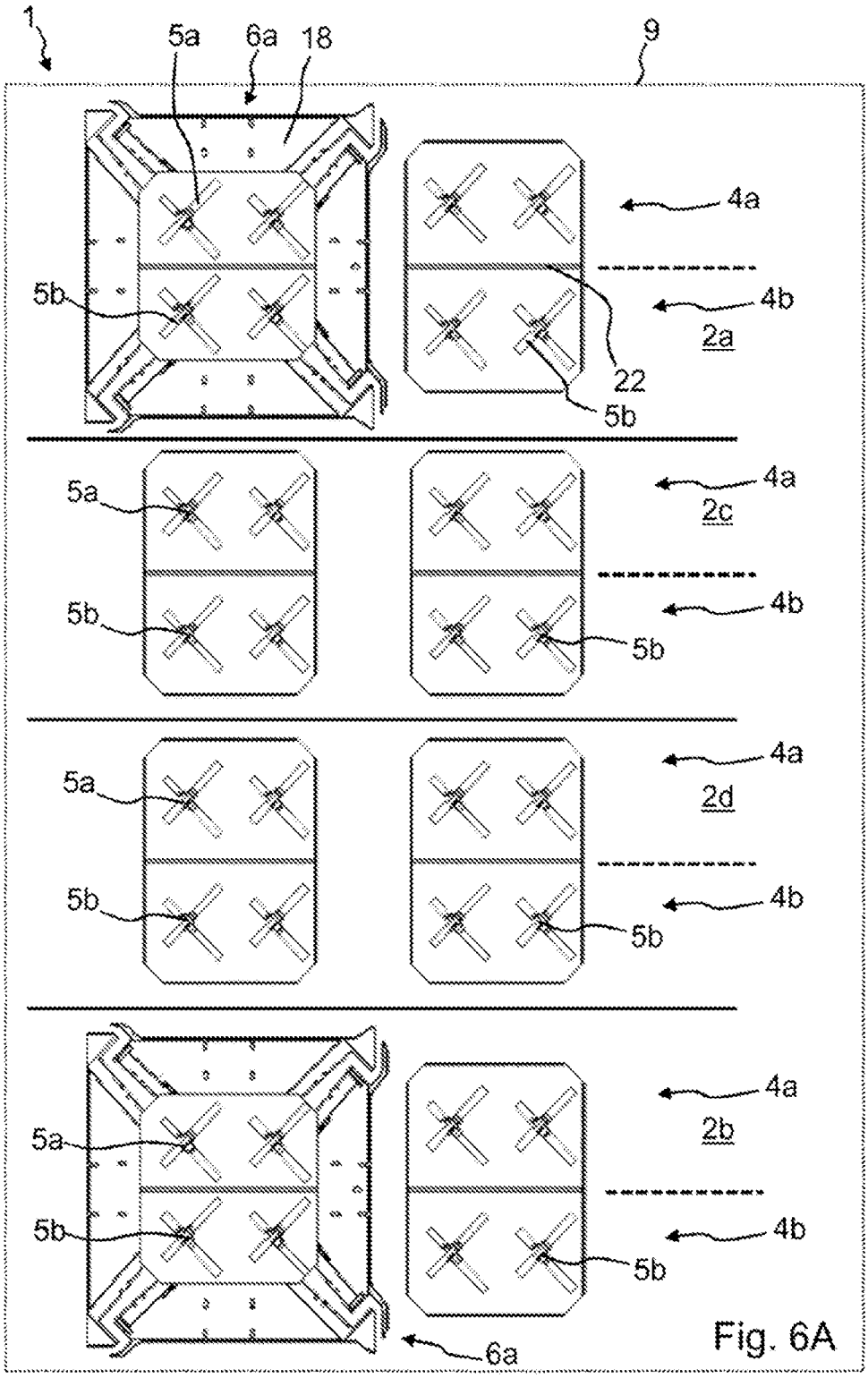

FIG. 6A also shows a plan view of an embodiment of the multiband antenna array 1 according to the invention with four radiating element arrays 2*a*, 2*b*, 2*c* and 2*d* with regard to the rows 4*a*, 4*b* of MIMO radiating elements. The dotted lines indicate that further dual-polarised radiating elements 5*a*, 5*b* and low-band radiating elements 6*b*, 6*c* (at least in the first and second radiating element array 2*a*, 2*b*) follow. This could be a plan view, for example, of the embodiments according to FIGS. 1C and 1D.

The dual-polarised low-band radiating elements 6*a*, 6*b*, 6*c* extend in the first and second radiating element arrays 2*a*, 2*b* preferably over the entire length in the longitudinal direction 3. This means that a correspondingly large number of dual-polarised low-band radiating elements 6*a*, 6*b*, 6*c* are used. By contrast, the rows 4*a*, 4*b* of MIMO radiating elements and the rows 7 of wideband radiating elements are arranged in series. When the multiband antenna array 1 is installed, they are then piled up, i.e. are stacked. The rows 4*a*, 4*b* of MIMO radiating elements and the corresponding row 7 of wideband radiating elements are then arranged vertically (i.e. at different distances from the ground) one above the other.

The individual radiating element arrays 2*a*, 2*b*, 2*c*, 2*d* run in particular parallel to each other. Each of these radiating element arrays 2*a*, 2*b*, 2*c*, 2*d* comprises at least two rows 4*a*, 4*b* of MIMO radiating elements, which can each be operated in two different polarisations, whereby massive MIMO operation is possible overall.

Figure 6B:
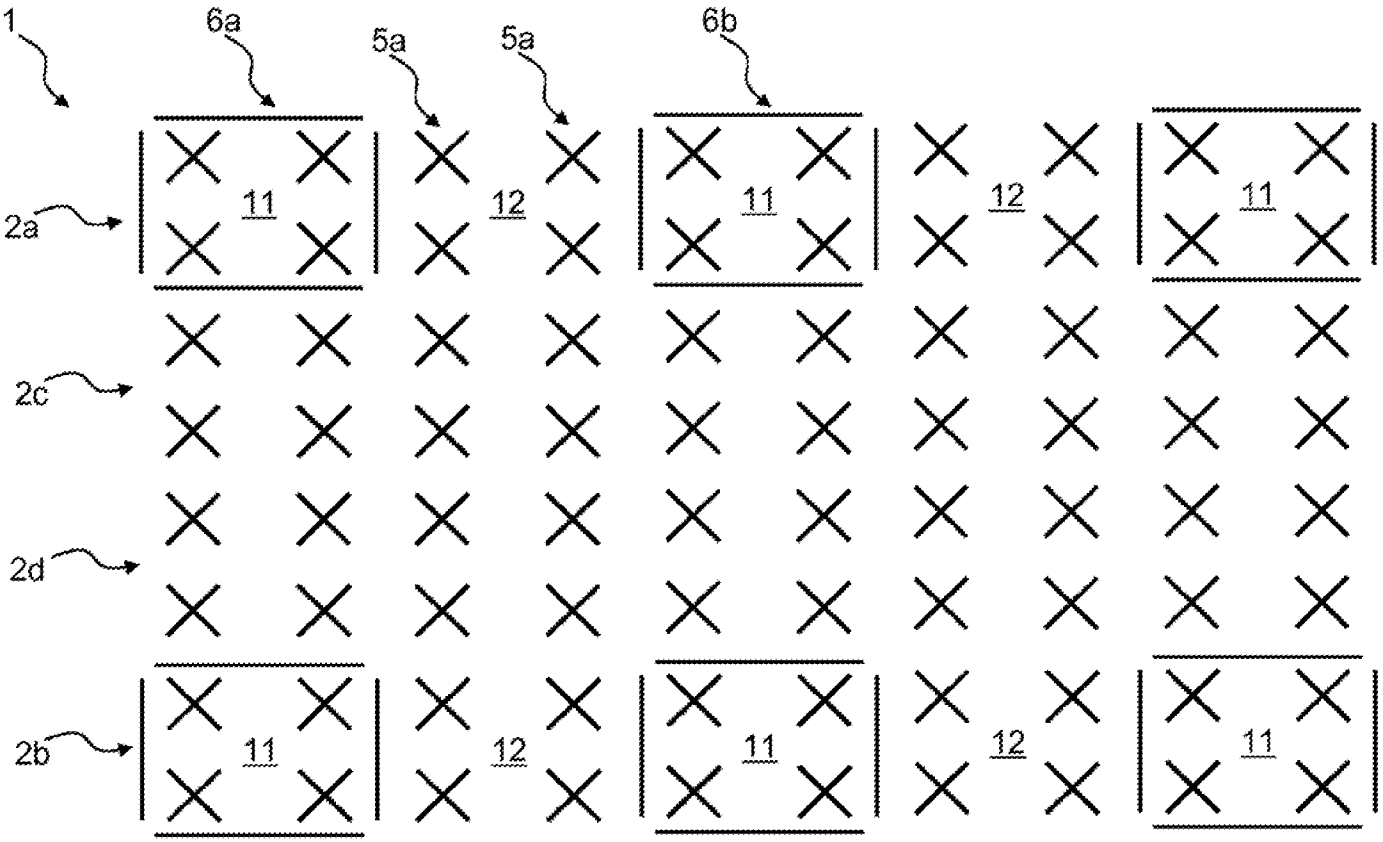

FIG. 6B is a more general depiction of FIG. 6A. The design details of the individual radiating element arrays 2*a*, 2*b*, 2*c*, 2*d* are not shown here. Instead, a number of dual-polarised low-band radiating elements 6*a*, 6*b* etc. and a number of dual-polarised radiating elements 5*a*, 5*b* etc. are shown. It can be seen that two dual-polarised low-band radiating elements 6*a*, 6*b* of the same radiating element array 2*a*, 2*b* are not arranged directly adjacently to one another. There is a gap 12 between each two of these dual-polarised low-band radiating elements 6*a*, 6*b* of the same radiating element array 2*a*, 2*b*, which gap is selected to be of such a size that, for each row 4*a*, 4*b* of MIMO radiating elements, it accommodates at least one, preferably (at least or exactly) two dual-polarised radiating elements 5*a*, 5*b*. In particular, the number of dual-polarised radiating elements 5*a*, 5*b* in the gap 11 corresponds to the number of dual-polarised radiating elements 5*a*, 5*b* in the accommodation space 11. The dual-polarised radiating elements 5*a*, 5*b* of the relevant row 4*a*, 4*b* of MIMO radiating elements preferably always have the same spacing from one another. The same preferably also applies to the dual-polarised low-band radiating elements 6*a*, 6*b* of the radiating element arrays 2*a*, 2*b*. The dual-polarised low-band radiating elements 6*a*, 6*b* of different radiating element arrays 2*a*, 2*b* are also arranged in FIG. 6B at such a distance from one another that the radiating element arrays 2*c*, 2*d*, which are free of dual-polarised low-band radiating elements 6*a*, 6*b*, are arranged in between. There may be more than two, three, four, five, six, seven, eight, nine or more than ten dual-polarised low-band radiating elements 6*a*, 6*b* in each of the radiating element arrays 2*a*, 2*b*. The dual-polarised low-band radiating elements 6*a*, 6*b* can extend over the entire length of the multiband antenna array 1, which, due to the use of rows 7 of wideband radiating elements, preferably does not apply to the dual-polarised radiating elements 5*a*, 5*b*.

The invention is not limited to the described embodiments. Within the scope of the invention, all described and/or drawn features can be combined as desired.

In a multiband antenna array according to some embodiments, the dual-polarised radiating elements of the first and the second row of MIMO radiating elements are patch-like radiating elements or dipole-like radiating elements, in particular vector dipoles, crossed dipoles or dipole squares.

In a multiband antenna array according to some embodiments, the dual-polarised radiating elements of the first row of MIMO radiating elements are arranged approximately along a straight line; and/or the dual-polarised radiating elements of the second row of MIMO radiating elements are arranged approximately along a straight line.

In a multiband antenna array according to some embodiments, the number of dual-polarised radiating elements of the first row of MIMO radiating elements corresponds to the number of dual-polarised radiating elements of the second row of MIMO radiating elements.

In a multiband antenna array according to some embodiments, a gap is formed between the at least one dual-polarised low-band radiating element and the at least one further dual-polarised low-band radiating element, wherein in the gap there are as many dual-polarised radiating elements as in the accommodation space.

In a multiband antenna array according to some embodiments, the dual-polarised radiating elements of the first and/or second row of MIMO radiating elements which are arranged inside the accommodation space of the at least one dual-polarised low-band radiating element do not protrude beyond this at least one dual-polarised low-band radiating element.

In a multiband antenna array according to some embodiments, a partition wall arrangement is arranged between the dual-polarised radiating elements of the first and the second row of MIMO radiating elements; and/or the dual-polarised radiating elements of the first row of MIMO radiating elements extend equally far away from the reflector array, and/or the dual-polarised radiating elements of the second row of MIMO radiating elements extend equally far away from the reflector array.

The invention claimed is:

1. Multiband antenna array for mobile radio, comprising:

at least one first radiating element array comprising at least one first and one second row of Multiple Input Multiple Output (MIMO) radiating elements, which rows are arranged adjacently to each other and extend in the longitudinal direction of the multiband antenna array;

the first row of MIMO radiating elements and the second row of MIMO radiating elements each comprising a large number of dual-polarised radiating elements, wherein each dual-polarised radiating element is designed to transmit and/or receive in two perpendicular polarisation planes in an upper frequency range;

the at least one first radiating element array further comprising at least one dual-polarised low-band radiating element which is designed to transmit and/or receive in two perpendicular polarisation planes in a lower frequency range;

a reflector array, from which:

a) the dual-polarised radiating elements of the first and second rows of MIMO radiating elements; and b) the at least one dual-polarised low-band radiating element are spaced;

the at least one dual-polarised low-band radiating element comprising at least four directive radiating element devices, each of the at least four directive radiating element devices having a continuous directive structure, two adjacent directive radiating element devices among the at least four directive radiating element devices being offset relative to one another by at least approximately 90° and separate from one another with a slot, the at least four directive radiating element, devices delimit an accommodation space;

in the accommodation space of the at least one dual-polarised low-band radiating element there are:

a) at least one dual-polarised radiating element from the first row of MIMO radiating elements and at least one dual-polarised radiating element from the second row of MIMO radiating elements; or b) at least two dual-polarised radiating elements from the first row of MIMO radiating elements and at least two dual-polarised radiating elements from the second row of MIMO radiating elements.

2. Multiband antenna array according to claim 1, wherein:
the first and the second row of MIMO radiating elements are a row of massive MIMO radiating elements.

3. Multiband antenna array according to claim 1, wherein:
the lower frequency range of the at least one dual-polarised low-band radiating element is below the upper frequency range of the dual-polarised radiating elements of the first and the second row of MIMO radiating elements;
the lower frequency range is 698 MHz to 960 MHz; and/or
the upper frequency range is higher than 3.3 GHz or 3.4 GHz, or 3.5 GHz or 4 GHz or 4.5 GHz or 5 GHz or 5.5, but preferably lower than 6.5 GHz or 6 GHz or 5.5 GHz or 5 GHz or 4.5 GHz or 4 GHz or 3.6 GHz or 3.5 GHz.

4. Multiband antenna array according to claim 1, wherein:
the at least one first radiating element array also comprises at least one further dual-polarised low-band radiating element;
the at least one further dual-polarised low-band radiating element is arranged on the reflector array so as to be spaced from the at least one dual-polarised low-band radiating element in the longitudinal direction and/or is spaced from the reflector array;
in an accommodation space of the at least one further dual-polarised low-band radiating element there are:
a) at least one dual-polarised radiating element from the first row of MIMO radiating elements and at least one dual-polarised radiating element from the second row of MIMO radiating elements; or
b) at least two dual-polarised radiating elements from the first row of MIMO radiating elements and at least two dual-polarised radiating elements from the second row of MIMO radiating elements; and
a gap is formed between the at least one dual-polarised low-band radiating element and the at least one further dual-polarised low-band radiating element;
wherein in the gap there are:
a) at least one dual-polarised radiating element from the first row of MIMO radiating elements and at least one dual-polarised radiating element from the second row of MIMO radiating elements; or
b) at least two dual-polarised radiating elements from the first row of MIMO radiating dements and at least two dual-polarised radiating elements from the second row of MIMO radiating elements.

5. Multiband antenna array according to claim 4 wherein:
the at least one dual-polarised low-band radiating element and the at least one further dual-polarised low-band radiating element are arranged along a straight line; and/or
those of the dual-polarised radiating elements from the first row of MIMO radiating elements that are arranged inside the accommodation spaces are arranged along a first straight line, and those of the dual-polarised radiating elements from the first row of MIMO radiating elements that are arranged outside the accommodation spaces are arranged along a second straight line, wherein
a) the course of the first and second straight line is identical; or
b) the first straight line is spaced from the second straight line, but parallel to it; and/or
those of the dual-polarised radiating elements from the second row of MIMO radiating elements that are arranged inside the accommodation spaces are arranged along a third straight line, and those of the dual-polarised radiating elements from the second row of MIMO radiating elements that are arranged outside the accommodation spaces are arranged along a fourth straight line, wherein:
a) the course of the third and the fourth straight line is identical; or
b) the third straight line is spaced from the fourth straight line, but parallel to it.

6. Multiband antenna array according to claim 4, wherein:
a distance between two adjacent dual-polarised radiating elements of the first row of MIMO radiating elements is greater when one of these radiating elements is arranged inside an accommodation space and the other radiating element is arranged outside the accommodation space than when both adjacent radiating elements are arranged inside the accommodation space or outside the accommodation space; and/or
a distance between two adjacent dual-polarised radiating elements of the second row of MIMO radiating elements is greater when one of these radiating elements is arranged inside an accommodation space and the other radiating element is arranged outside the accommodation space than when both adjacent radiating elements are arranged inside the accommodation space or outside the accommodation space.

7. Multiband antenna array according to claim 4, wherein:
a distance between two adjacent dual-polarised radiating elements of the first row of MIMO radiating elements is always the same; and/or
a distance between two adjacent dual-polarised radiating elements of the second row of MIMO radiating elements is always the same.

8. Multiband antenna array according to claim 1, wherein:
each of the dual-polarised radiating elements of the first row of MIMO radiating elements and each of the dual-polarised radiating elements of the second row of MIMO radiating elements comprises a feed point for a first polarisation and a feed point for a second polarisation; and
a) a first phase shifter is provided and:
i) the feed points for the first polarisation of the dual-polarised radiating elements of the first row of MIMO radiating elements are electrically connected to different connection points of the first phase shifter; or
(ii) feed points for the first polarisation of at least two adjacent dual-polarised radiating elements of the first, row of MIMO radiating elements are electrically connected to each other and to a common connection point of the first phase shifter;
and/or
b) a second phase shifter is provided and:
i) the feed points for the second polarisation of the dual-polarised radiating elements of the first row of MIMO radiating elements are electrically connected to different connection points of the second phase shifter; or
(ii) feed points for the second polarisation of at least two adjacent dual-polarised radiating elements of the first row of MIMO radiating elements are electrically connected to each other and to a common connection point of the second phase shifter; and/or
c) a third phase shifter is provided and:
i) the feed points for the first polarisation of the dual-polarised radiating elements of the second row of MIMO radiating elements are electrically connected to different connection points of the third phase shifter; or (ii) ked points for the first polarisation of at least two adjacent dual-polarised radiating elements of the second row of MIMO radiating elements are electrically connected to each other and to a common connection point, of the third phase shifter;

and/or d) a fourth phase shifter is provided and:

i) the feed points for the second polarisation of the dual-polarised radiating elements of the second row of MIMO radiating elements are electrically connected to different connection points of the fourth phase shifter; or ii) feed points for the second polarisation of at least two adjacent dual-polarised radiating elements of the second row of MIMO radiating elements are electrically connected to each other and to a common connection point of the fourth phase shifter.

9. Multiband antenna array according to claim 8, wherein:

the feed points of the first or second polarisation of those of the at least two adjacent dual-polarised radiating elements of the first or second row of MIMO radiating elements that are arranged inside the accommodation space or outside the accommodation space are connected to one another.

10. Multiband antenna array according to claim 1, wherein:

the at least four directive radiating element devices of the at least one dual-polarised low-band radiating element are each held at a distance from the reflector array by a holding device;

a slot is formed between two holding devices of adjacent radiating element devices and extends away from the reflector array;

the two holding devices are partially nested in one another so that the slot has a course that is angled at least once or multiple times.

11. Multiband antenna array according to claim 1, wherein:

the at least one first radiating element array comprises at least one row of wideband radiating elements, which is arranged at the end of the first and the second row of MIMO radiating elements and extends the multiband antenna array in the longitudinal direction;

the at least one row of wideband radiating elements comprises a large number of dual-polarised wideband radiating elements, wherein each dual-polarised wideband radiating element is designed to transmit and/or receive in two perpendicular polarisation planes in a medium frequency range.

12. Multiband antenna array according to claim 11, wherein:

the medium frequency range of the dual-polarised wideband radiating elements of the at least one row of wideband radiating elements is:

a) above the lower frequency range of the at least one dual-polarised low-band radiating element; and b) below the upper frequency range of the dual-polarised radiating elements of the first and second rows of MIMO radiating elements.

13. Multiband antenna array according to claim 11, wherein:

the medium frequency range is higher than 1.3 GHz or 1.4 GHz or 1.427 GHz or 1.5 GHz or 1.6 GHz or 1.695 GHz, but preferably lower than 3 GHz or 2.8 GHz or 2.7 GHz or 2.690 GHz.

14. Multiband array according to claim 11, wherein:

the at least one first radiating element array comprises additional dual-polarised low-band radiating elements;

at least one dual-polarised wideband radiating element of the at least one row of wideband radiating elements is arranged in the accommodation space of these additional dual-polarised low-band radiating elements.

15. Multiband antenna array according to claim 11, wherein:

the dual-polarised wideband radiating elements of the at least one row of wideband radiating elements each comprise a feed point for a first polarisation and a feed point for a second polarisation, and:

a) the dual-polarised wideband radiating elements of the at least one row of wideband radiating elements are:

i) connected with their feed points for the first polarisationindirectly or directly to the same signal source; and ii) connected with their feed points for the second polarisation indirectly or directly to the same signal source;

or b) the dual-polarised wideband radiating elements of the at least one row of wideband radiating elements are assigned to different groups:

i) wherein the dual-polarised wideband radiating elements of a first group are connected with their feed points for the first polarisation indirectly or directly to a first signal source; and wherein the dual-polarised wideband radiating elements of a second group are connected with their feed points for the first polarisation indirectly or directly to a second signal source; and ii) wherein the dual-polarised wideband radiating elements of the first group are connected h their feed points for the second polarisation indirectly or directly to a third signal source; and wherein the dual-polarised wideband radiating elements of the second group are connected with their feed points for the second polarisation indirectly or directly to a fourth signal source.

16. Multiband antenna array according to claim 1, wherein:

a second radiating element array extends adjacently to the first radiating element array and likewise comprises at least one first and one second row of MIMO radiating elements, which rows are arranged adjacently to each other and extend in the longitudinal direction of the multiband antenna array;

the at least one second radiating element array likewise comprises at least one dual-polarised low-band radiating element, which is designed to transmit and/or receive in two perpendicular polarisation planes in a lower frequency range.

17. Multiband antenna array according to claim 16, wherein:

a third radiating element array and a fourth radiating element array extend between the first radiating element array and the second radiating element array and likewise each comprise at least one first and one second row of MIMO radiating elements, which rows are arranged adjacently to one another and extend in the longitudinal direction of the multiband antenna array;

the third and the fourth radiating element array are free of at least one dual-polarised low-band radiating element.

18. Multiband antenna array according to claim 16, wherein:

a further partition wall arrangement is arranged between two adjacent radiating element arrays.

19. Multiband antenna array according to claim 1, wherein:

the dual-polarised radiating elements of the first row of MIMO radiating elements are arranged in the longitudinal direction of the multiband antenna array without any offset relative to the dual-polarised radiating elements of the second row of MIMO radiating elements.

20. A dual polarized cross dipole, comprising:

a first dipole radiating element and a second dipole radiating element, wherein:

the first dipole radiating element comprises two dipole halves and the second dipole radiating element comprises two dipole halves;

the first dipole half of the first dipole radiating element comprises a ground connection point support and a dipole ground wing, wherein a first end of the dipole ground wing is connected to a first end of the ground connection point support, and wherein a second end of the ground connection point support, which is opposite the first end, can be arranged on at least one main body;

the second dipole half of the first dipole radiating element comprises a signal connection point support having a first end and an opposite, second end and a dipole signal wing, wherein a first end of the dipole signal wing is connected to the first end of the signal connection point support;

the first dipole half of the second dipole radiating element comprises a ground connection point support and a dipole ground wing, wherein a first end of the dipole ground wing is connected to a first end of the ground connection point support, and wherein a second end of the ground connection point support, which is opposite the first end, can be arranged on the at least one main body;

the second dipole half of the second dipole radiating element comprises a signal connection point support having a first end and an opposite, second end and a dipole signal wing, wherein a first, end of the dipole signal wing is connected to the first end of the signal connection point support;

the signal connection point support of the first dipole radiating element runs parallel or with one component predominantly parallel to the ground connection point support of the first dipole radiating element, and the signal connection point support of the second dipole radiating element runs parallel or with one component predominantly parallel to the ground connection point support of the second dipole radiating element;

the dipole signal wing and the dipole ground wing of the first dipole radiating element run in opposite directions;

the dipole signal wing and the dipole ground wing of the second dipole radiating element run in opposite directions; and the dipole signal wing of the second dipole radiating element dips under the dipole signal wing of the first dipole radiating element, or the dipole ground wing of the second dipole radiating element dips under the dipole ground wing of the first dipole radiating element, or the dipole ground wing of the first dipole radiating element dips under the dipole signal wing of the second dipole radiating element, or the dipole signal wing of the second dipole radiating element dips under the dipole ground wing of the first dipole radiating element.

* * * * *